US009590289B1

(12) United States Patent
Dufour et al.

(10) Patent No.: US 9,590,289 B1
(45) Date of Patent: Mar. 7, 2017

(54) HARSH-ENVIRONMENT COMMUNICATIONS ANTENNAE AND METHOD FOR PROVIDING SUCH ANTENNAE

(71) Applicant: MRV SYSTEMS, LLC, San Diego, CA (US)

(72) Inventors: James Edward Dufour, Solana Beach, CA (US); Brian Kenneth Newville, San Diego, CA (US)

(73) Assignee: MRV Systems, LLC, San Diego, CA (US)

( * ) Notice: Subject to any disclaimer, the term of this patent is extended or adjusted under 35 U.S.C. 154(b) by 842 days.

(21) Appl. No.: 14/095,974

(22) Filed: Dec. 3, 2013

Related U.S. Application Data

(60) Provisional application No. 61/797,184, filed on Dec. 3, 2012.

(51) Int. Cl.
*H01Q 1/40* (2006.01)
*H01Q 1/04* (2006.01)

(52) U.S. Cl.
CPC ..... *H01Q 1/04* (2013.01); *H01Q 1/40* (2013.01)

(58) Field of Classification Search
CPC ..... H01Q 1/04; H01Q 1/40; Y10T 29/49948; Y10T 29/49954
USPC ..... 343/873, 719; 29/600
See application file for complete search history.

(56) References Cited

U.S. PATENT DOCUMENTS 3,896,447 A * 7/1975 Majkrzak ..... H01Q 1/08 343/709
6,195,057 B1 * 2/2001 Kornblith ..... H01Q 1/10 175/18
2011/0267242 A1 * 11/2011 Carroll ..... H01Q 1/34 343/709
2012/0032861 A1 * 2/2012 Crowley ..... H01Q 9/30 343/725

* cited by examiner

*Primary Examiner* — Hoanganh Le
(74) *Attorney, Agent, or Firm* — Sheppard Mullin Richter & Hampton LLP

(57) ABSTRACT

Communications antennae suitable for operating in harsh environmental conditions and methods for providing such antennae are disclosed. Exemplary implementations of the communications antenna may provide an ability to transmit and receive radio frequency signals while being exposed to formidable conditions for many years. Such conditions may include one or more of shallow and deep ocean, radioactive, ultraviolet, ultra cold, ultra-high pressure, and/or other harsh environments. The antenna may be ruggedized to withstand attacks by marine mammals and fish, encounters with fishing equipment including nets and lines, entanglement with marine debris, abrasion (e.g., by coral, sand, rock, and/or other objects), collision with maritime vessels and submersibles, and/or other unpredictable events. The efficient radio frequency design and efficient form factor may provide users with a small, unobtrusive device with a capacity for extensive integration in the radio frequency domain.

15 Claims, 8 Drawing Sheets

HARSH-ENVIRONMENT COMMUNICATIONS ANTENNAE AND METHOD FOR PROVIDING SUCH ANTENNAE

CROSS REFERENCE TO RELATED APPLICATIONS

This application claims the priority benefit of U.S. Provisional Patent Application No. 61/797,184 filed on Dec. 3, 2012 and entitled "Harsh Environment Data/Communications Broadband Antenna," the entire disclosure of which being incorporated herein by reference.

FIELD OF THE DISCLOSURE

This disclosure relates to communications antennae suitable for operating in harsh environmental conditions and methods for providing such antennae.

BACKGROUND

Conventional communications and voice and data telemetry antennas, such as those equipped on vehicles, vessels, and aircraft, typically resist ordinary environmental conditions such as wind, sun, cold, and salt water. Existing technologies may not be suitable in more extreme conditions such as deep-ocean pressure, high altitude, sub-freezing, and/or other harsh conditions—particularly when specific RF characteristics and strength are needed. Compromising the performance of the antenna may not be an option when addressing the difficulties related to fulfilling specifications associated with harsh environmental conditions. Further, it is not an uncommon experience to rely on these devices for extended periods with little or no inspection or service. Antennas exhibiting reliable, functional service may be required in many of the harshest conditions on earth for many years, even decades.

SUMMARY

One aspect of the disclosure relates to a method for providing communications antennae suitable for operating in harsh environmental conditions. The method may comprise removably attaching a proximal end of a communications antenna to a mold. The communications antenna may comprise a base disposed at the proximal end connected by a mast to an antenna element at a distal end of the communications antenna. The antenna element may comprise a conductive trace disposed on a planar dielectric substrate. The planar dielectric substrate may have a first side opposing a second side. The mold may be configured to provide a form for a monolithic coating to be applied to the communications antenna. The mold may comprise ports near the distal end. A given port may be configured to accommodate a pin configured to be (1) extended through the given port to contact the antenna element or (2) retracted through the given port to release contact from the antenna element. The method may comprise securing a position of the distal end of the communication antenna within the mold by extending pins from two or more opposing ports so that the pins contact the distal end and hold the distal end in place. The method may comprise introducing a coating material into the mold so that the coating material flows around the communications antenna. The method may comprise retracting the pins responsive to the coating material flowing around the antenna element at the distal end of the communications antenna so that the position of the antenna element is fixed within the mold. The coating material may fill volumes previously occupied by the pins so that a continuous monolithic coating of the communication antenna results after the pins are retracted.

Another aspect of the disclosure relates to a method for providing communications antennae suitable for operating in harsh environmental conditions. The method may comprise securing a position of an antenna element within a mold. The antenna element may comprise a conductive trace disposed on a planar dielectric substrate. The planar dielectric substrate may have a first side opposing a second side. The mold may be configured to provide a form for a monolithic coating to be applied to the antenna element. The mold may comprise ports where a given port may be configured to accommodate a pin configured to be (1) extended through the given port to contact the antenna element or (2) retracted through the given port to release contact from the antenna element. The position of the antenna element may be secured within the mold by extending pins from two or more opposing ports so that the pins contact the antenna element and hold the antenna element in place. The method may comprise introducing a coating material into the mold so that the coating material flows around the antenna element. The method may comprise retracting the pins responsive to the coating material flowing around the antenna element so that the position of the antenna element is fixed within the mold. The coating material may fill volumes previously occupied by the pins so that a continuous monolithic coating of the communication antenna results after the pins are retracted.

Yet another aspect of the disclosure relates to a communications antenna suitable for operating in harsh environmental conditions. The communications antenna may comprise a base connected by a mast to an antenna element, the antenna element comprising a conductive trace disposed on a planar dielectric substrate. The communications antenna may further comprise a continuous monolithic coating encasing the antenna element. The coating may be configured to enable operation of the communications antenna in harsh environmental conditions.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
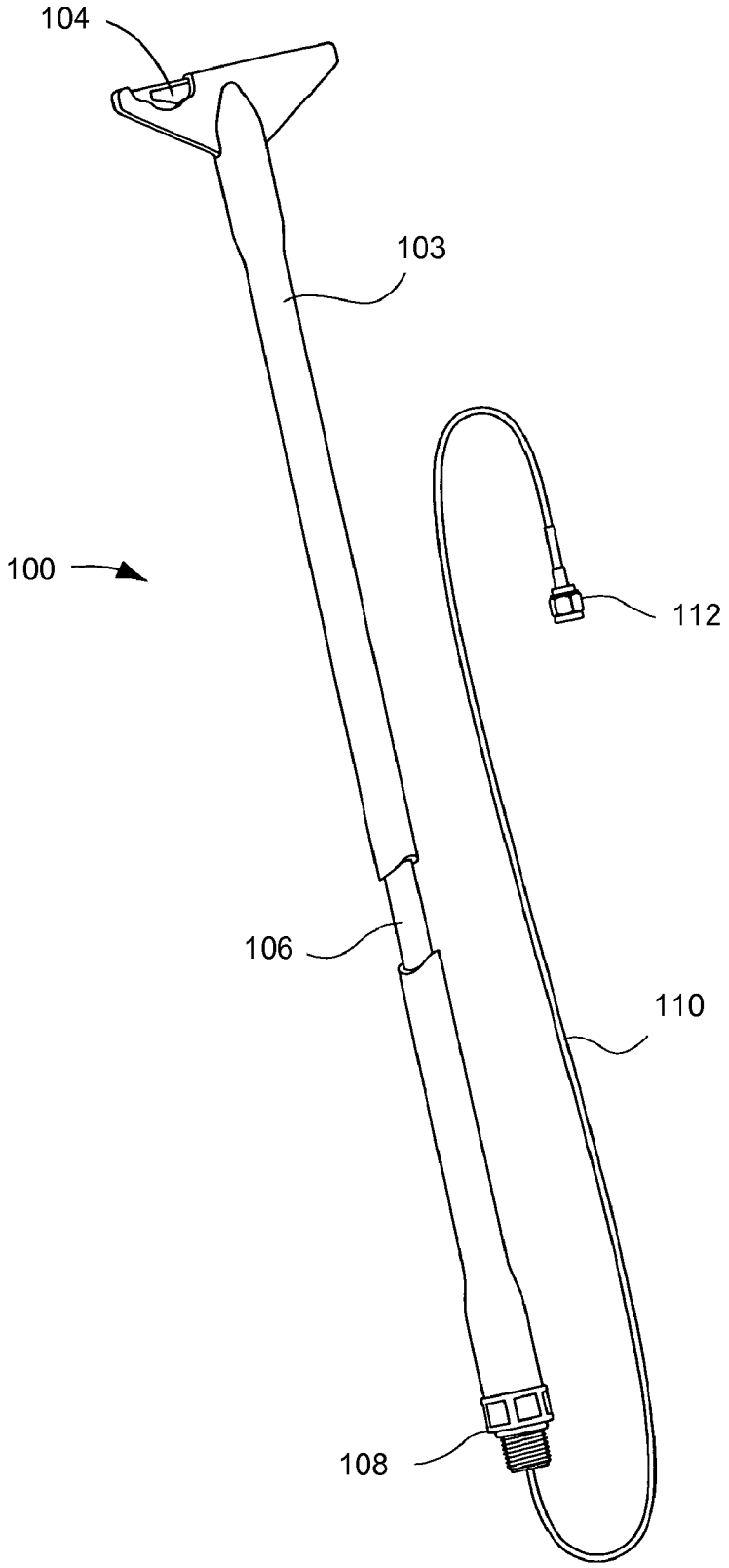
FIG. 1 illustrates a perspective view of a communications antenna with a monolithic coating, in accordance with one or more implementations.

FIG. 1 illustrates a perspective view of a communications antenna 100 with a monolithic coating, in accordance with one or more implementations. Exemplary implementations of antenna 100 may provide an ability to transmit and receive radio frequency signals while being exposed to formidable conditions for many years. Such conditions may include one or more of shallow and deep ocean, radioactive, ultraviolet, ultra cold, ultra-high pressure, and/or other harsh environments. The antenna 100 may be ruggedized to withstand attacks by marine mammals and fish, encounters with fishing equipment including nets and lines, entanglement with marine debris, abrasion (e.g., by coral, sand, rock, and/or other objects), collision with maritime vessels and submersibles, and/or other unpredictable events. The efficient radio frequency design and efficient form factor may provide users with a small, unobtrusive device with a capacity for extensive integration in the radio frequency domain.

The communication antenna 100 may include one or more of a coating 103, an antenna element 104, a mast 106, a base 108, a coaxial cable 110, a coaxial connector 112, and/or other components. The coaxial cable 110 may provide electrical connectivity between antenna element 104 and a radio transceiver (not depicted) connected by coaxial connector 112.

The coating 103 may be comprised of a material designed to protect internal components of antenna 100 (e.g., antenna element 104, mast 106, base 108, and/or other components) from harsh environmental conditions, while still allowing high-efficiency communications by antenna 100. The coating 103 may protect internal components of antenna 100 by encasing one or more components with a monolithic coating. The coating 103 may be continuous without patches or other weak points. The coating 103 may include one or more materials tailored for comprehensive temperature pliability, low water absorption, stable dielectric constant, UV resistance, high impact resistance, abrasion resistance, chemical resistance, low visibility, flame resistance, and/or other characteristics. Indeed, in some implementations, antenna 100 may be operable under water at greater than 12,000 PSI, which corresponds to depths of more than about 8,000 meters. The coating 103 may include one or more of an elastomeric material, a thermoplastic, a synthetic rubber, a ceramic, and/or other materials. Examples of such a thermoplastic may include polyamide-imide (PAI, i.e., Torlon®), acetals, phenolics, polyethylene, PEEK, UHMW, FEP, ULTEM®, EXTEM®, and/or other thermoplastics. Examples of synthetic rubbers may include one or more of nitriles, butyls, EPDM, ethylene propylene, fluoroelastomers, neoprene, HNBR, polyurethane, PTFE, silicone, and/or other synthetic rubber.

The coating 103 may affect performance characteristics of antenna 100, particularly by frequency shifting the transmission efficiency profile (i.e., transmission and/or reception efficiency as a function of frequency). The antenna 100 may be designed in anticipation of this shift so that antenna 100 is operable at one or more specific frequencies and/or ranges of frequencies after coating 103 is applied. In order for the frequency shift to be predictable, and to maintain a desirable efficiency profile, a thickness of coating 103 over antenna element 104 may be extremely accurate and consistent. In some implementations, a tolerance for the thickness of coating 103 may be ±0.002 inches (0.05 millimeters). Indeed, in some implementations, if the thickness of coating 103 is increased or decreased just two thousandths of an inch, the optimal operating frequency could be drastically shifted and/or performance could otherwise be severely impaired, which are some reasons why molding may be preferable over dipping or spraying the coating material of coating 103. Exemplary methods for achieving such consistent thickness for coating 103 are described in connection with FIG. 8.

Figure 2:
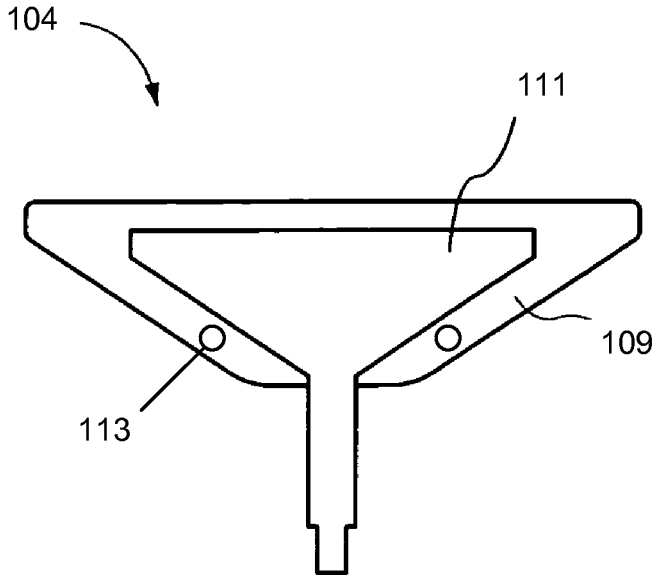
FIG. 2 illustrates a front view of an antenna element for the communications antenna of FIG. 1 without a monolithic coating, in accordance with one or more implementations.

FIG. 2 illustrates a front view of antenna element 104 without coating 103, in accordance with one or more implementations. The antenna element 104 may include one or more of a dielectric substrate 109, a conductive material 111, one or more alignment holes 113, and/or other components. The alignment hole(s) 113 may be configured to facilitate alignment of antenna element 104 within a mold used to apply coating 103, as described in connection with FIGS. 7 and 8. The antenna element 104 may be configured to be mechanically integrated with mast 106. Such integration may be achieved by one or more of press fitting, a threaded connection, clamping, an adhesive connection, bonding, and/or other techniques.

The dielectric substrate 109 may include a non-conducting material configured to support deposited materials (e.g., conductive materials). In some implementations, dielectric substrate 109 may be planar (with a first side and a second side) or some other shape. The dielectric substrate 109 may include a circuit board similar to what may be found in a common printed circuit board (PCB). The dielectric substrate 109 may include one or more insulating materials such as a thermoset resin, cloth, paper, ceramic, kapton, fiber-reinforced plastic (FRP), and/or other insulating materials.

The conductive material 111 may be disposed on dielectric substrate 109. In some implementations, conductive material 111 may be deposited on dielectric substrate 109. In some implementations where conductive material 111 initially covers a side of dielectric substrate 109, portions conductive material 111 may be etched away to leave a pattern exhibiting desired antenna characteristics. The conductive material 111 may include one or more conducting materials such as copper, aluminum, silver, gold, tin-plated copper, and/or other conducting materials.

The antenna element 104 may be configured to achieve maximum efficiency and gain once coated with coating 103. According to some implementations, antenna element 104 may have an operating range of 400 megahertz to 3.5 gigahertz. The antennal element 104 may have a minimum bandwidth of 250 megahertz centered at one or more operating frequencies. The antennal element 104 may exhibit a maximum voltage standing wave ratio (VSWR) of 1.15. The antennal element 104 may provide an impedance match in its operating range of S 11≤−10 decibels. During operation, antennal element 104 may have a radiation pattern that is omnidirectional (e.g., torus). It will be appreciated that the physical and operational characteristics of antenna element 104 described herein are not intended to be limiting as other physical configurations and/or operating ranges are contemplated and within the scope of the disclosure.

Figure 3:
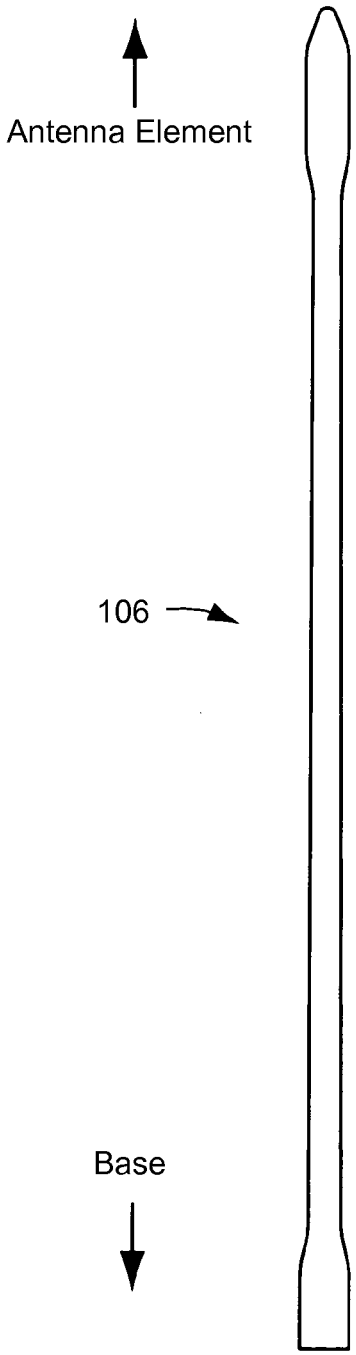
FIG. 3 illustrates a front view of a mast for the communications antenna of FIG. 1 without a monolithic coating, in accordance with one or more implementations.

FIG. 3 illustrates a front view of mast 106 without coating 103, in accordance with one or more implementations. The mast 106 may be configured to extend antenna element 104 away from a body (not depicted) to which antenna 100 is mounted. The mast 106 may serve to connect antenna element 104 with base 108. The mast 106 may range in length, in various implementations. For example, mast 106 may be less than three centimeters in length up to several meters in length, depending on the particular application. The mast 106 may have a cross-sectional shape that is circular, hexagonal, square, and/or other shapes. In exemplary implementations, mast 106 may be configured to provide one or more characteristics suitable for operating in harsh environmental conditions. Examples of such characteristics may include one or more of resisting hydrostatic pressure up to 12,000 PSI, being rigid, being incapable of affecting radio signals, providing strong adhesion capabilities for coating 103, and/or other characteristics. The mast 106 may be made from one or more of fiber-reinforced plastic, carbon graphite, metal (e.g., aluminum, titanium, and/or other metals), and/or other materials.

Figure 4:
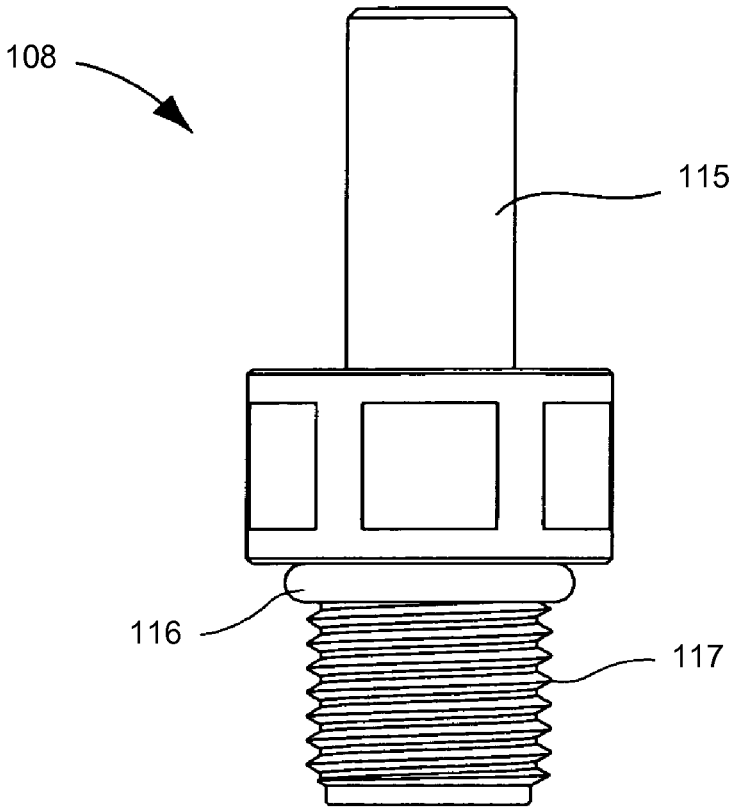
FIG. 4 illustrates a front view of a base for the communications antenna of FIG. 1 without a monolithic coating, in accordance with one or more implementations.

FIG. 4 illustrates a front view of base 108 without coating 103, in accordance with one or more implementations. The base 108 may include one or more of a mounting element 115, a sealing element 116, an installing element 117, and/or other components. The mounting element 115 may be configured to mechanically integrate base 108 with mast 106. Such integration may be achieved by one or more of press fitting, a threaded connection, clamping, an adhesive connection, bonding, and/or other techniques. The sealing element 116 may be configured to provide a seal between antenna 100 and a body (not depicted) to which antenna 100 is mounted. The seal may prevent one or more of air, water, and/or other environmental elements from reaching interior components of antenna 100. The sealing element 116 may include one or more of a polymeric ring, and/or other component configured to provide a seal. The installing element 117 may be configured to mechanically integrate base 108 with a body (not depicted) to which antenna 100 is mounted. Such integration may be permanent or temporary, and may be achieved by one or more of press fitting, a threaded connection, clamping, an adhesive connection, bonding, and/or other techniques.

Figure 5:
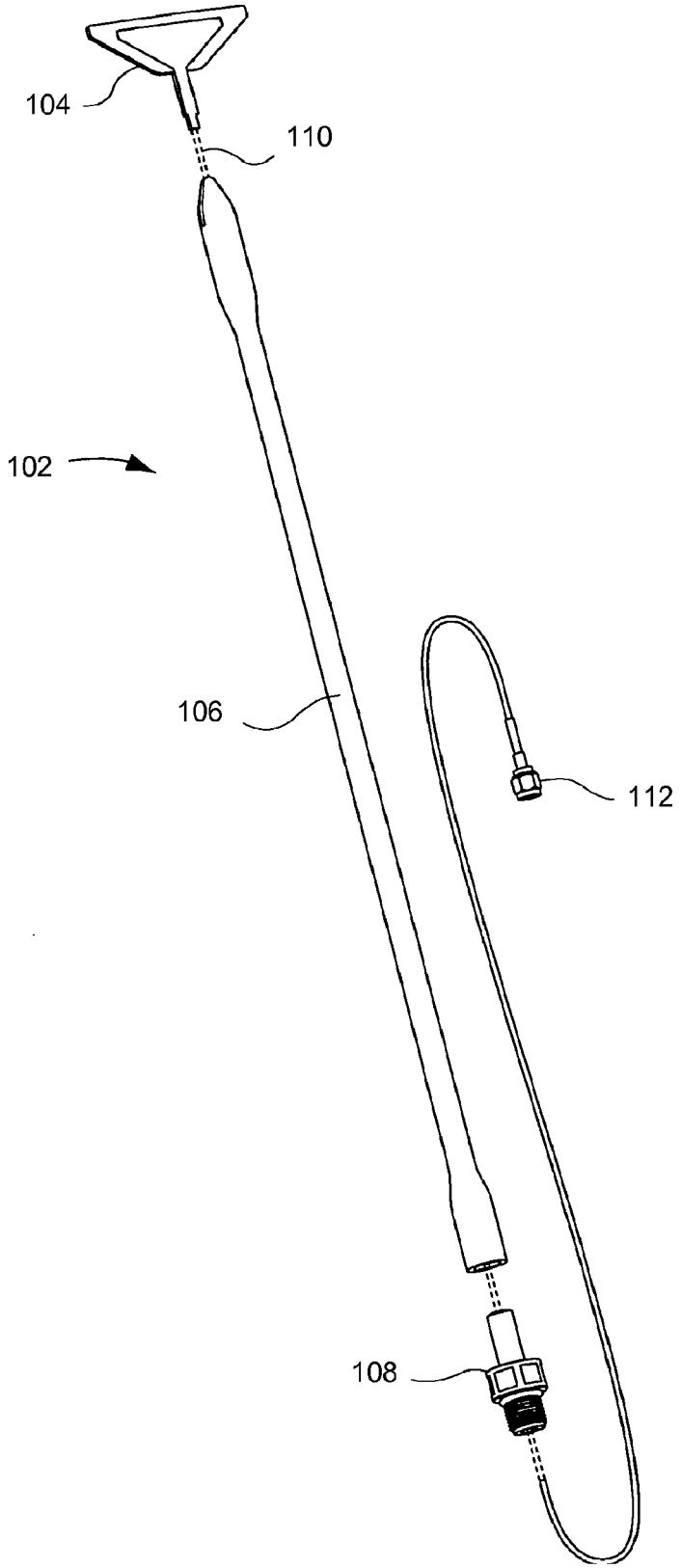
FIG. 5 illustrates a perspective exploded view of internal components of the communications antenna of FIG. 1 without a monolithic coating, in accordance with one or more implementations.
Figure 6:
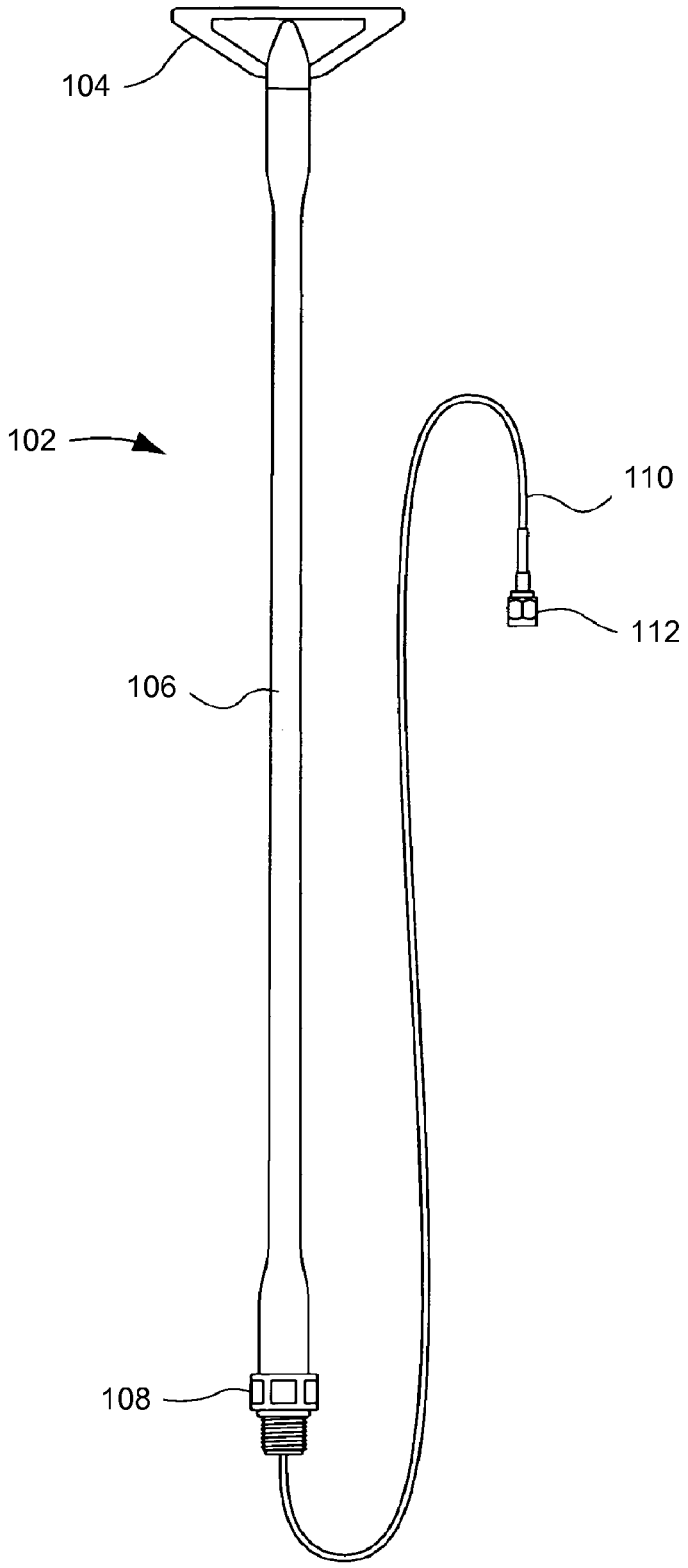
FIG. 6 illustrates a front view of assembled internal components of the communications antenna of FIG. 1 without a monolithic coating, in accordance with one or more implementations.

FIG. 5 illustrates a perspective exploded view of internal components 102 of antenna 100 without coating 103, in accordance with one or more implementations. FIG. 6 illustrates a front view of assembled internal components 102 of communications antenna of FIG. 1 without coating 103, in accordance with one or more implementations. The antennal element 104 may be attached to mast 106 so that it is disposed at a proximal end of antenna 100. The base 108 may be attached to mast 106 so that it is disposed at a distal end of antenna 100. The coaxial cable 110 may electrically connect with antenna element 104, while passing internally through mast 106 and base 108 ultimately connecting by coaxial connector 12 to a radio transceiver (not depicted).

Figure 7:
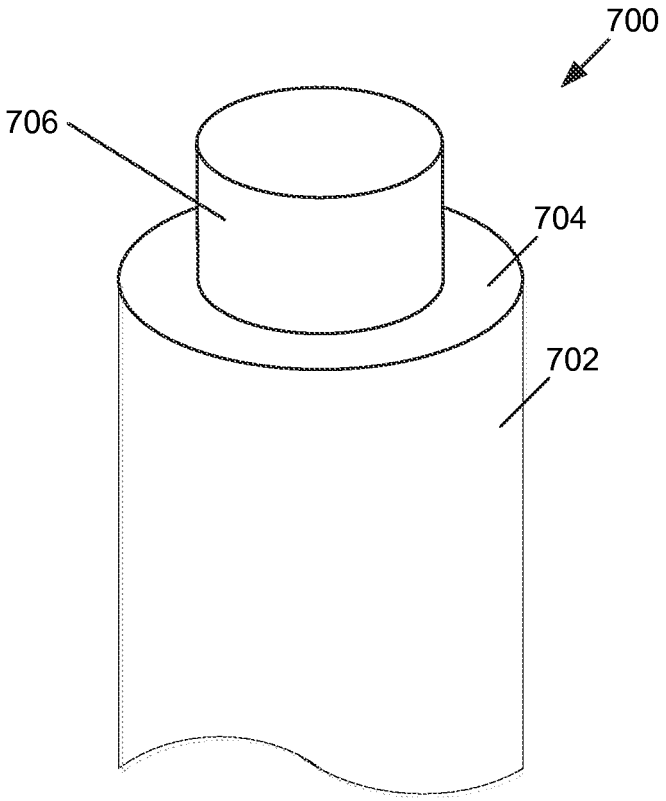
FIG. 7 illustrates a working end of a pin configured to position a communications antenna within a mold, in accordance with one or more implementations.

FIG. 7 illustrates a pin 700 with a working end 702 configured to position antenna 100—particularly antenna element 104—within a mold used to apply coating 103, in accordance with one or more implementations. The working end 702 may be cylindrical with a shoulder 704 to a reduced diameter cylindrical shape 706 configured to fit within a hole (e.g., alignment hole(s) 113 shown in FIG. 2) in antenna element 104. The shoulder 704 may contact a first side or a second side of antenna element 104 when the reduced diameter cylindrical shape 706 is fully inserted into the hole of antenna element 104. The pin 700 may facilitate ensuring an accurate and consistent thickness of coating 103 over antenna element 104. The pin 700 may be made from a metal rod, and may be configured to fit within a precision-ported hole in the mold.

Figure 8:
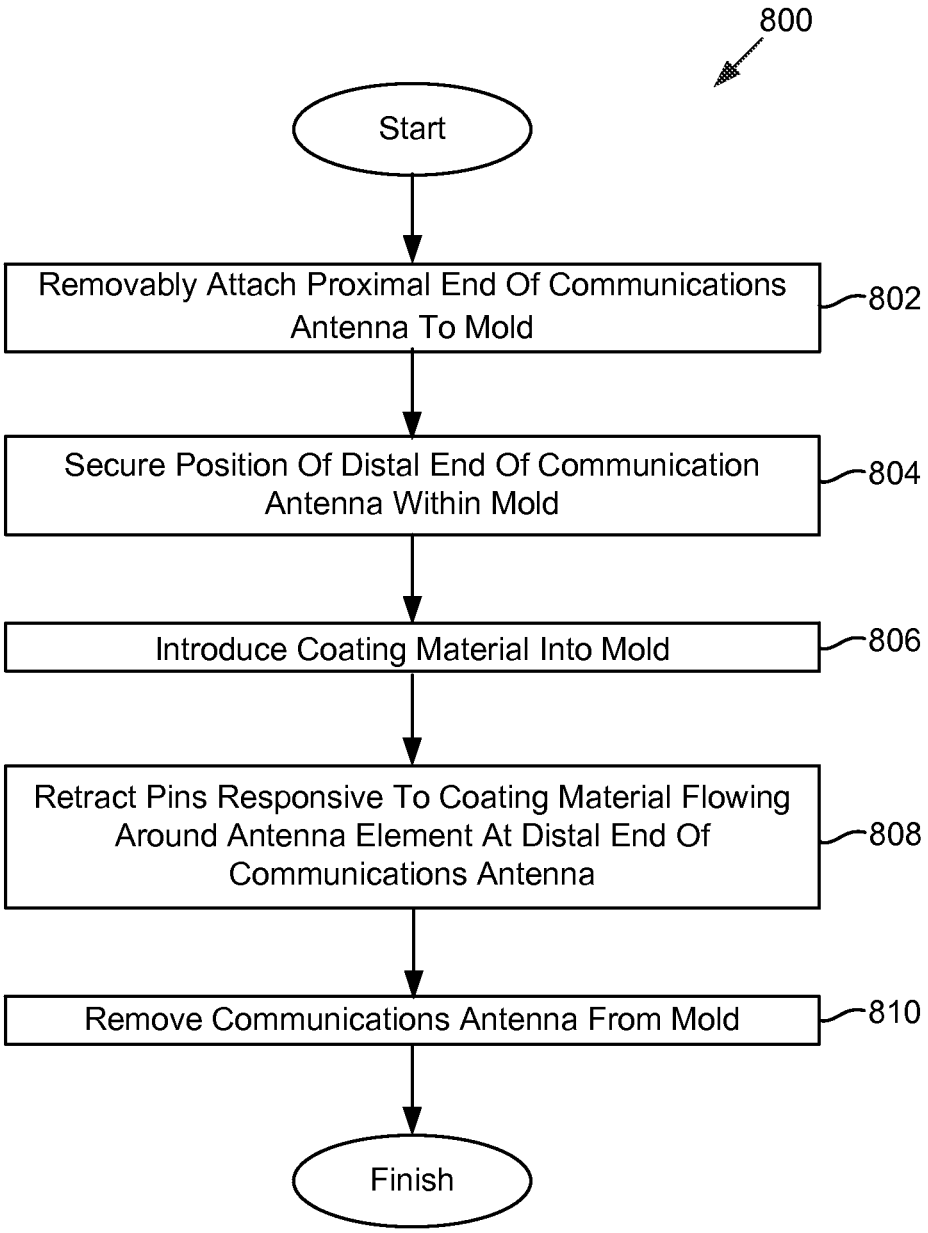
FIG. 8 illustrates a method for providing communications antennae suitable for operating in harsh environmental conditions, in accordance with one or more implementations.

FIG. 8 illustrates a method for providing communications antennae suitable for operating in harsh environmental conditions, in accordance with one or more implementations. The operations of method 800 presented below are intended to be illustrative. In some implementations, method 800 may be accomplished with one or more additional operations not described, and/or without one or more of the operations discussed. Additionally, the order in which the operations of method 800 are illustrated in FIG. 8 and described below is not intended to be limiting.

At an operation 802, a proximal end of a communications antenna (e.g., antenna 100) may be removably attaching to a mold. The communications antenna may comprise a base (e.g., base 108) disposed at the proximal end connected by a mast (e.g., mast 106) to an antenna element (e.g., antenna element 104) at a distal end of the communications antenna. The antenna element may comprise a conductive trace (e.g., conductive material 111) disposed on a planar dielectric substrate (e.g., dielectric substrate 109) having a first side opposing a second side. The mold may be configured to provide a form for a monolithic coating (e.g., coating 103) to be applied to the communications antenna. The mold may comprise ports near the distal end of the communications antenna. A given port may be configured to accommodate a pin (e.g., pin 700) configured to be (1) extended through the given port to contact the antenna element or (2) retracted through the given port to release contact from the antenna element.

At an operation 804, a position of the distal end of the communication antenna may be secured within the mold. Securing the distal end may include extending pins from two or more opposing ports so that the pins contact the distal end and hold the distal end in place. A first end of a given pin may be cylindrical with a shoulder to a reduced diameter cylindrical shape (see, e.g., FIG. 7) configured to fit within a hole (e.g., alignment hole 113) in the antenna element. The shoulder may contact the first side or the second side of the antenna when the reduced diameter cylindrical shape is fully inserted into the hole of the antenna element.

At an operation 806, a coating material may be introduced into the mold so that the coating material flows around the communications antenna. In some implementations, in order to avoid shifting within the mold, the coating material may be introduced into the mold near the proximal end of the communications antenna, away from the antenna element. The coating material may be very viscous like tar. The coating material may become hard packed within the mold at pressures ranging from two to three thousand PSI. One or more molding techniques may be performed at operation 806. Examples of such techniques may include injection, compression, transfer, and/or other molding techniques.

At an operation 808, the pins may be retracted responsive to the coating material flowing around the antenna element at the distal end of the communications antenna so that the position of the antenna element is fixed within the mold. In some implementations, the pins may not be retracted until the coating material completely fills the mold and is packed around the antenna element. The coating material may fill volumes previously occupied by the pins so that a continuous monolithic coating of the communication antenna results after the pins are retracted. Indeed, any void created during pin retraction may be immediately filled with the coating material. Because those volumes are relatively small, and because the pressure of the coating material within the mold may be very high, the coating material may flow out through the ports of the pins.

At an operation 810, the communications antenna may be removed from the mold. The communications antenna may be removed after the coating material completely fills any voids left by the retracted pins. Spurs remaining where the pins held the communication antenna may be removed.

Alternative methods may exist for providing a coating over antenna element 104. For example, spacers of the appropriate thickness may be placed between antenna element 104 and the mold so that the coating material flows around the spacers while the spacers maintain a desired distance between antenna element 104 and the mold. Such spacers may, in effect, be patches in a resulting coating 103, which may be weak points. According to another example, antenna 100 may be dipped in a coating material configured for dipping (e.g., urethane), but such materials generally may not exhibit desired RF and/or environmentally resistant properties. In yet another example, a simple split mold may be used with a non-elastomer material (e.g., a thermoplastic such as polyethylene or polyurethane) that is poured into the mold. Such materials, however, generally may not exhibit desired RF and/or environmentally resistant properties.

Although the above disclosure describes only an antenna element (e.g., antenna element 104) being disposed at the proximal end of a communications antenna (e.g., antenna 100), this is not intended to be limiting as other components are contemplated as being similarly disposed and are within the scope of the disclosure. For example, some implementations may include, at the proximal end of a communications antenna, one or more of a second conductive material with RF properties differing from conductive material 111, other types of antennae (e.g., Bluetooth), a camera, a light source (e.g., an LED), a sound source, high-frequency acoustics, an altimeter, a pressure sensor, a temperature sensor, a motion sensor (e.g., accelerometer), other sensors, a compass, recovery aids (e.g., a lanyard, a hook, and/or other recovery aids), retrieval and deployment devices, and/or other components. In implementations where light needs to be able to pass through coating 103, such as with a camera or an LED, a transparent member (e.g., a sapphire crystal) may be embedded within coating 103. The surfaces of the transparent member to be bonded may be sand blasted so that the coating material of coating 103 may bond directly to the transparent member.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A method for providing communications antennae suitable for operating in harsh environmental conditions, the method comprising:

removably attaching a proximal end of a communications antenna to a mold, the communications antenna comprising a base disposed at the proximal end connected by a mast to an antenna element at a distal end of the communications antenna, the antenna element comprising a conductive trace disposed on a planar dielectric substrate, the planar dielectric substrate having a first side opposing a second side, the mold being configured to provide a form for a monolithic coating to be applied to the communications antenna, the mold comprising ports near the distal end, a given port being configured to accommodate a pin configured to be (1) extended through the given port to contact the antenna element or (2) retracted through the given port to release contact from the antenna element;

securing a position of the distal end of the communication antenna within the mold by extending pins from two or more opposing ports so that the pins contact the distal end and hold the distal end in place;

introducing a coating material into the mold so that the coating material flows around the communications antenna; and retracting the pins responsive to the coating material flowing around the antenna element at the distal end of the communications antenna so that the position of the antenna element is fixed within the mold, wherein the coating material fills volumes previously occupied by the pins so that a continuous monolithic coating of the communication antenna results after the pins are retracted.

2. The method of claim 1, wherein a thickness of the coating material at the antenna element is consistent to within two thousandths of an inch.

3. The method of claim 1, wherein the coating material includes one or more of an elastomeric material, a thermoplastic, a synthetic rubber, or a ceramic.

4. The method of claim 1, wherein the coating material is introduced into the mold near the proximal end of the communications antenna, away from the antenna element.

5. The method of claim 1, wherein the communications antenna is operable under water at greater than 12,000 PSI.

6. The method of claim 1, wherein the mast is constructed of one or more of fiber-reinforced plastic, carbon graphite, aluminum, or titanium.

7. The method of claim 1, wherein a first end of a given pin is cylindrical with a shoulder to a reduced diameter cylindrical shape configured to fit within a hole in the antenna element, the shoulder contacting the first side or the second side of the antenna when the reduced diameter cylindrical shape is fully inserted into the hole of the antenna element.

8. A communications antenna produced in accordance with the method of claim 1.

9. A method for providing communications antennae suitable for operating in harsh environmental conditions, the method comprising:

securing a position of an antenna element within a mold, the antenna element comprising a conductive trace disposed on a planar dielectric substrate, the planar dielectric substrate having a first side opposing a second side, the mold being configured to provide a form for a monolithic coating to be applied to the antenna element, the mold comprising ports, a given port being configured to accommodate a pin configured to be (1) extended through the given port to contact the antenna element or (2) retracted through the given port to release contact from the antenna element, wherein the position of the antenna element is secured within the mold by extending pins from two or more opposing ports so that the pins contact the antenna element and hold the antenna element in place;

introducing a coating material into the mold so that the coating material flows around the antenna element; and retracting the pins responsive to the coating material flowing around the antenna element so that the position of the antenna element is fixed within the mold, wherein the coating material fills volumes previously occupied by the pins so that a continuous monolithic coating of the communication antenna results after the pins are retracted.

10. The method of claim 9, wherein a thickness of the coating material at the antenna element is consistent to within two thousandths of an inch.

11. The method of claim 9, wherein the coating material includes one or more of an elastomeric material, a thermoplastic, a synthetic rubber, or a ceramic.

12. The method of claim 9, the coating material is introduced into the mold at a location far from an area of where a thickness of the coating material is critical.

13. The method of claim 9, wherein the communications antenna is operable under water at greater than 12,000 PSI.

14. The method of claim 9, wherein a first end of a given pin is cylindrical with a shoulder to a reduced diameter cylindrical shape configured to fit within a hole in the antenna element, the shoulder contacting the first side or the second side of the antenna when the reduced diameter cylindrical shape is fully inserted into the hole of the antenna element.

15. An antenna element produced in accordance with the method of claim 9.

* * * * *